US009113526B2

(12) United States Patent
Stewart

(10) Patent No.: US 9,113,526 B2
(45) Date of Patent: Aug. 18, 2015

(54) CONTROLLER AND METHOD OF CONTROLLING A LIGHT EMITTING DEVICE

(71) Applicant: Dwight L. Stewart, Johnston, IA (US)

(72) Inventor: Dwight L. Stewart, Johnston, IA (US)

( * ) Notice: Subject to any disclaimer, the term of this patent is extended or adjusted under 35 U.S.C. 154(b) by 0 days.

(21) Appl. No.: 14/060,299

(22) Filed: Oct. 22, 2013

(65) Prior Publication Data

US 2015/0108918 A1 Apr. 23, 2015

(51) Int. Cl.
*H05B 37/02* (2006.01)
*H05B 33/08* (2006.01)

(52) U.S. Cl.
CPC ..... *H05B 33/0842* (2013.01)

(58) Field of Classification Search
CPC ... H05B 33/0815; H05B 37/0254; G05F 3/02
USPC ..... 315/291, 294, 297, 307
See application file for complete search history.

(56) References Cited

U.S. PATENT DOCUMENTS

| | | | | |
|---|---|---|---|---|
| 7,427,840 | B2 * | 9/2008 | Morgan et al. | 315/295 |
| 7,550,935 | B2 * | 6/2009 | Lys et al. | 315/318 |
| 8,344,641 | B1 * | 1/2013 | Isaacson et al. | 315/250 |
| 8,378,781 | B1 * | 2/2013 | Peterson | 340/3.5 |
| 8,567,982 | B2 * | 10/2013 | Zampini et al. | 362/125 |
| 2005/0236998 | A1 * | 10/2005 | Mueller et al. | 315/51 |
| 2010/0079091 | A1 * | 4/2010 | Deixler et al. | 315/320 |
| 2013/0193873 | A1 * | 8/2013 | Isaacson et al. | 315/294 |

* cited by examiner

*Primary Examiner* — Jason M Crawford
(74) *Attorney, Agent, or Firm* — David M. Breiner; Camille L. Urban

(57) ABSTRACT

Example embodiments relate to a controller and a method of controlling a light emitting device.

39 Claims, 9 Drawing Sheets

FIG. 2

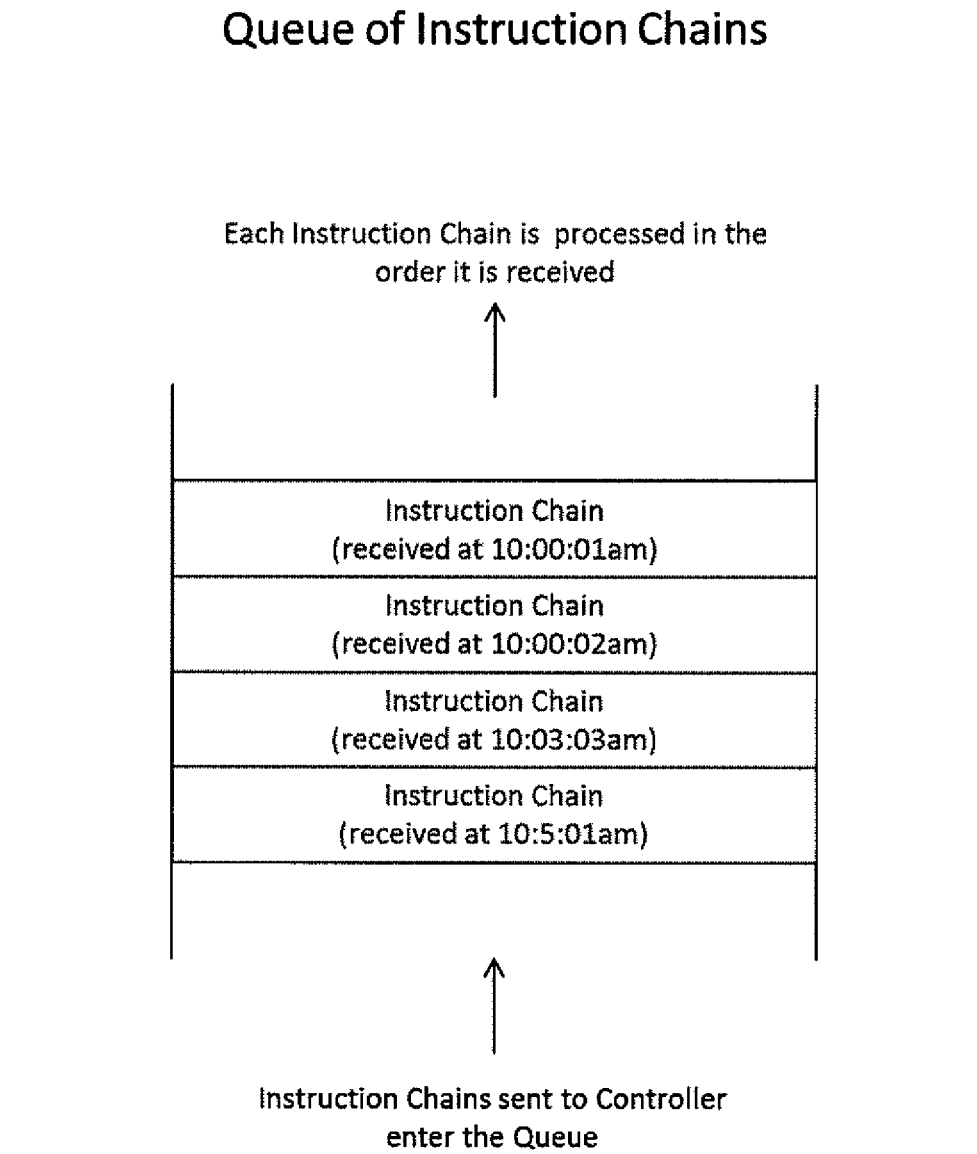

If a received Instruction Chain includes a command to process immediately (i.e. "!" character exists in the newly received Instruction Chain) then the Queue is cleared, the currently executing Instruction Chain is forced to stop processing, and the newly received instruction begins processing. Alternatively, the newly received Instruction Chain may be sent to the queue before it starts processing.

CONTROLLER AND METHOD OF CONTROLLING A LIGHT EMITTING DEVICE

BACKGROUND

1. Field

Example embodiments relate to a controller and a method of controlling a light emitting device. In example embodiments, the light emitting device may be controlled using a sequence of terse command instructions.

2. Description of the Related Art

A light-emitting diode (LED) is a semiconductor device capable of generating light when subjected to an electrical current. The color of light emitted by an LED is influenced by the type of semiconductor material used therein. For example, an LED comprised of aluminum gallium arsenide (AlGaAs) will produce a red light, an LED comprised of aluminum gallium indium phosphide (AlGaInP) will produce a green light, and an LED comprised of zinc selenide (ZnSe) or Indium gallium nitride (InGaN) will produce a blue light.

In the conventional art artisans have produced what is commonly referred to as an RGB diode. An RGB diode is comprised of three semiconductor materials. The first semiconductor material may be configured to produce a red light, the second semiconductor material may be configured to produce a green light, and the third semiconductor material may be configured to produce a blue light. In the RGB diode, the semiconductor materials are placed relatively close together. As such, light from the first semiconductor material, the second semiconductor material, and the third semiconductor material may be added together to produce a wide array of colors under a scheme commonly referred to as additive color mixing. For example, the RBG diode may appear to emit a yellow light when current flows through the semiconductor materials configured to emit the green and red lights but not the semiconductor material configured to produce the blue light.

SUMMARY

Traditional light controllers communicate over AC power or data buses that are not native to information technology networks. These traditional light controllers typically use fragmented communications methods due to the limitations and constraints of communicating over those networks. There is, therefore, a need for a command structure that can send a number of instructions to a light controller with fewer communication calls over an information-technology network using TCP/IP, UDP, or other transport protocol.

Example embodiments relate to a controller and a method of controlling a light emitting device. In example embodiments, the light emitting device may be controlled using a sequence of terse command instructions. The syntax associated with example embodiments may be used with lighting controllers that communicate on an information-technology network using TCP/IP, UDP, or other transport protocol. In comparison to the conventional art, example embodiments disclose a command structure that can send a number of instructions to a light controller with fewer communication calls over an information-technology network using TCP/IP, UDP, or other transport protocol.

Example embodiments may be embodied in an LED controller with one or more light channels. The LED light controller may include a command input, power, some number of light channel outputs, and a processor. The command syntax may provide a means of specifying a chain of unary instructions to set the output intensity of multiple light channels, and set a duration for transitioning light channels from the last setting to the new request. In example embodiments, the command syntax may be expanded to set the transition algorithms from settings such as linear or sine. Additionally, the command syntax may allow for chaining instructions to create a sequence of instructions, as well as repeating a sequence a specified number of times. In addition, the command syntax may allow for pausing until a specified time, or forcing immediate execution of the instructions rather than waiting for the previously sent instructions to complete. In example embodiments, the light channels may be, but are not limited to, red, green, blue, and white.

In example embodiments, each light channel may use pulse width modulation or some sort of amperage regulation to control the perceived brightness of one or more attached LEDs. Each channel may be expected to have LEDs of the same color, presumably a dedicated channel for red, green, blue, and white, for the purpose of individually adjusting the brightness of each color so colors may be blended to create an overall desired color output.

In accordance with example embodiments, an illumination controller may include a data input and a plurality of outputs. In example embodiments, the data input may be configured to receive a sequence of instructions, wherein the instructions have at least one fade command that specifies a fade duration and at least one color code. In example embodiments, the plurality of outputs may be configured to control a plurality of light emitting devices. In example embodiments, the light emitting devices may include a first device configured to emit a first light of a first color, a second device configured to emit a second light of a second color, and a third device configured to emit a third light of a third color. In example embodiments, the controller may be configured to determine, based on the at least one color code, a first target illumination level of the first light emitted by the first light emitting device, a second target illumination level of the second light emitted by the second light emitting device, and a third target illumination level the third light emitted by the third light emitting device. The controller may also be configured to control, based on the at least one fade command, the first light emitting device to emit light of the first target illumination level, the second light emitting device to emit light of the second target illumination level, and the third light emitting device to emit light of the third target illumination.

In accordance with example embodiments, a method of controlling a light may include receiving a sequence of instructions having at least one fade command that specifies a fade duration and at least one color code, determining, based on the at least one color code, a first target illumination level of a first light emitted by a first light emitting device, a second target illumination level of a second light emitted by a second light emitting device, and a third target illumination level of a third light emitted by a third light emitting device, and controlling, based on the at least one fade command, the first light emitting device to emit light of the first target illumination level, the second light emitting device to emit light of the second target illumination level, and the third light emitting device to emit light of the third target illumination.

In accordance with example embodiments, a non-transitory computer readable medium may be configured to cause a computer to determine a first target illumination level of a first light emitted by a first light emitting device, a second target illumination level of a second light emitted by a second light emitting device, and a third target illumination level of a third light emitted by a third light emitting device, and control, based on the at least one fade command, the first light emitting device to emit light of the first target illumination level, the second light emitting device to emit light of the second target illumination level, and the third light emitting device to emit light of the third target illumination.

In accordance with example embodiments, an illumination controller may be comprised of a data input configured to receive a sequence of instructions and a plurality of outputs configured to control a plurality of light emitting devices. In example embodiments the instructions may have at least one wait command and at least one color code. In example embodiments the light emitting devices may include a first device configured to emit a first light of a first color, a second device configured to emit a second light of a second color, and a third device configured to emit a third light of a third color. In example embodiments, the controller may be configured to determine, based on the at least one color code, a first target illumination level of the first light emitted by the first light emitting device, a second target illumination level of the second light emitted by the second light emitting device, and a third target illumination level of the third light emitted by the third light emitting device, and control, based on the at least one wait command, the first light emitting device to emit light of the first target illumination level, the second light emitting device to emit light of the second target illumination level, and the third light emitting device to emit light of the third target illumination.

BRIEF DESCRIPTION OF THE DRAWINGS

Example embodiments are described in detail below with reference to the attached drawing figures, wherein:

FIG. 2 is a view of a queue in accordance with example embodiments; and

DETAILED DESCRIPTION

Figure 1:
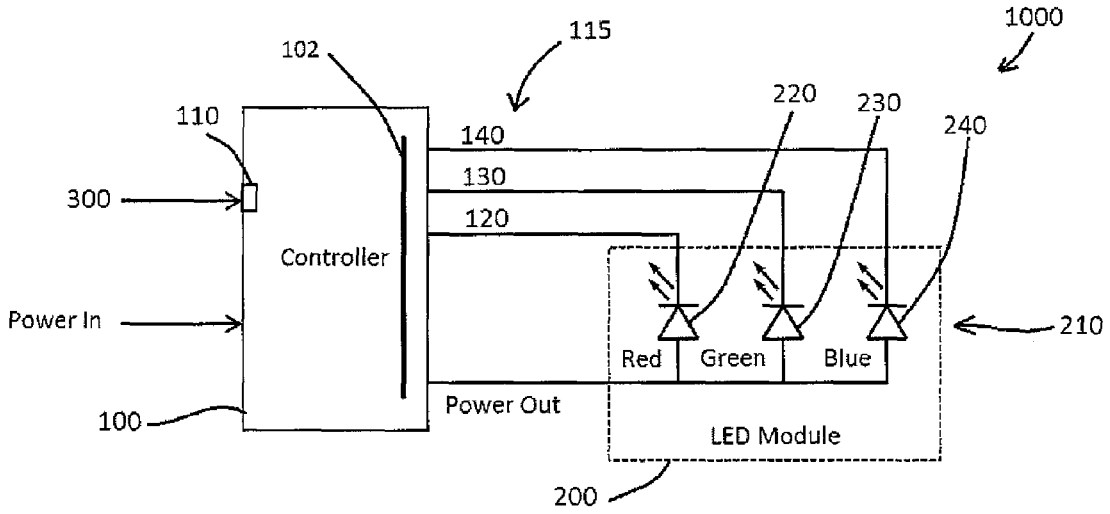
FIG. 1 is a view of a system in accordance with example embodiments.

Example embodiments will now be described more fully with reference to the accompanying drawings, in which example embodiments of the invention are shown. The invention may, however, be embodied in different forms and should not be construed as limited to the example embodiments set forth herein. Rather, these example embodiments are provided so that this disclosure will be thorough and complete, and will fully convey the scope of the invention to those skilled in the art. In the drawings, the sizes of components may be exaggerated for clarity.

In this application, it is understood that when an element or layer is referred to as being "on," "attached to," "connected to," or "coupled to" another element or layer, it can be directly on, directly attached to, directly connected to, or directly coupled to the other element or layer or intervening elements that may be present. In contrast, when an element is referred to as being "directly on," "directly attached to," "directly connected to," or "directly coupled to" another element, there are no intervening elements present. As used herein, the term "and/or" includes any and all combinations of one or more of the associated listed items.

In this application it is understood that, although the terms first, second, etc. may be used herein to describe various elements and/or components, these elements and/or components should not be limited by these terms. These terms are only used to distinguish one element, component, region, layer, and/or section from another elements, component, region, layer, and/or section. Thus, a first element, component region, layer or section discussed below could be termed a second element, component, region, layer, or section without departing from the teachings of example embodiments.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the structure in use or operation in addition to the orientation depicted in the figures. For example, if the structure in the figures is turned over, elements described as "below" or "beneath" other elements or features would then be oriented "above" the other elements or features. Thus, the exemplary term "below" can encompass both an orientation of above and below. The structure may be otherwise oriented (rotated 90 degrees or at other orientations) and the spatially relative descriptors used herein interpreted accordingly.

Embodiments described herein will refer to planform views and/or cross-sectional views by way of ideal schematic views. Accordingly, the views may be modified depending on manufacturing technologies and/or tolerances. Therefore, example embodiments are not limited to those shown in the views, but include modifications in configurations formed on the basis of manufacturing process. Therefore, regions exemplified in the figures have schematic properties and shapes of regions shown in the figures exemplify specific shapes or regions of elements, and do not limit example embodiments.

The subject matter of example embodiments, as disclosed herein, is described with specificity to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other technologies. Generally, example embodiments relate to controller and a method of controlling a light emitting device.

FIG. 1 is a view of a system 1000 in accordance with example embodiments. As shown in FIG. 1, the system 1000 may be comprised of a controller 100 and at least one light emitting module 200. In example embodiments, the light emitting module 200 may include a plurality of light emitting devices 210. For example, in FIG. 1, the plurality of light emitting devices 210 may be comprised of a first light emitting diode 220 to emit light of a first color, a second light emitting diode 230 to emit light of a second color, and a third light emitting diode 240 to emit light of a third color. For example, the first diode 220 may be configured to emit a red light, the second diode 230 may be configured to emit a green light, and the third diode 240 may be configured to emit a blue light. Thus, in example embodiments, the light emitting module 200 may resemble an RGB diode. This particular arrangement is not intended to limit the invention since the light emitting module 200 may include more than three diodes or less than three diodes. For example, the plurality of diodes 210 may include four or more diodes. In addition, the diodes of the light emitting module 200 may be configured to emit colors other than red, green, and blue. For example, the light emitting module 200 may be configured with a fourth diode configured to emit a white light, an orange light, a yellow light, a violet light, a purple light, and/or a pink light.

In example embodiments, the plurality of light emitting devices 210 may be spaced relatively close together. Thus, in example embodiments, light generated by the plurality of light emitting devices 210 may combine before being viewed by an observer. Accordingly, an observer may observe light having a property unlike the light generated by the individual light emitting devices 210. For example, in example embodiments, the first diode 220, the second diode 230, and the third diode 240 may be controlled by the controller 100 to generate a red light, a green light, and a blue light having the same illumination level. In such a case, light perceived by an individual viewing the diode module 200 may look white. As another example, the controller 100 may control the light emitting module so that the first diode 220 generates a red light having a first illumination level, the second diode 230 generates a green light having a second illumination level, and the third diode 240 generates a light as having zero illumination. When viewed by an observer, the light generated by the light emitting module 200 may look orange. In this application, it is noted that when the light emitting module 200 is described as producing a light of a certain color, it is meant the color perceived by a person when viewing the light emitting module 200.

In example embodiments, the controller 100 may include a data input 110 and a plurality of outputs 115. In example embodiments, the plurality of outputs 115 may connect the controller 100 to the light emitting module 200. For example, the plurality of outputs 115 may be comprised of a first output 120, a second output 130, and a third output 140 connecting the first diode 220, the second diode 230, and the third diode 240 to the controller 100. In example embodiments, each of the first, second, and third outputs may be wires which may be used to pulse modulate the first, second, and third diodes 220, 230, and 240.

In example embodiments, the controller 100 may be configured to receive an instruction chain 300 via the data input 110. The data input 110 may, for example, be a serial interface such as, but not limited to, an RS-232 interface or an RS-485 interface. The data input 110 may also be a wireless interface. Further yet, the data input 110 may be an IP network interface or a serial interface. Further yet, the data input 110 may be a Power-over-Ethernet interface or an Ethernet interface, for example, a Cisco EnergyWise interface. The controller 100 may use instruction chain 300 to control each of the light emitting devices of the light emitting module 200. For example, the instruction chain may include one or more commands configured to cause the controller 100 generate a first control signal, a second control signal, and a third control signal to control the first diode 220, the second diode 230, and the third diode 240. In example embodiments, the first, second, and third control signals may be communicated to the first diode 220, the second diode 230, and the third diode 240 via the first, second, and third outputs 120, 130, and 140. In example embodiments, each of the first, second, and third diodes 220, 230, and 240 may, for example, be controlled via pulse width modulation or by current modulation. In addition, the controller 100 may also include a linear driver 102 configured to regulate the power output to the first, second, and third channels. Of course, in example embodiments, it is understood the controller 100 may include a microprocessor configured to process the instruction chain 300 and control the first, second, and third diodes 220, 230, and 240.

In example embodiments the instruction chain 300 may be written as an ASCII string and the instruction chain 300 may include one or a plurality of commands. Table 1, for example, includes nonlimiting examples of commands that may be present in an instruction chain 300. As will be noted from a review of Table 1, the commands may cause the controller 100 to execute several operations such as, but not limited to, a change in light color emitted by the light emitting module, a fading operation, a delay in execution of a command, or a jump to instruction command.

TABLE 1

| Command | Command Description |
|---|---|
| x[y] | Fade command, where "x" is some number that represents the fade's duration, where "y" is any quantity of non-bracket characters that represent a color (thus, y is an example of a color code), using the last selected fade algorithm will be used for the fade, where if no fade algorithm had been preselected then some default fade algorithm would be used. In this application, the color may be specified in any format, for example, in HTML, Hex Code, or Decimal Code. |
| ! | Immediately jump to subsequent instruction command, where the processor would immediately stop processing any currently executing instruction and start executing instructions subsequent to this command regardless if there are unexecuted instructions sent earlier waiting to be processed |
| xT | Wait until a specific second before executing subsequent instructions, where "x" may be some number in a range, for example, between 0-59. In this application, x is an example of a specific time value. |
| xA | Select fade algorithm, where "x"is some number that indicates an algorithm to use for subsequent fade commands. The fade algorithm, for example, may be, but is not limited to, a linear or trigonometric function. |
| x{y} | Repeat, where "x" is some number that represents the quantity of times to repeat, where "y" is any process to be repeated. |

The following are examples of instruction chains in accordance with example embodiments.

Example 1

0[Pink]. This instruction chain includes one command (0[Pink]) to cause the controller 100 to control the light emitting module 200 to generate a color that would interpreted as pink by an observer. The controller may do so by pulse modulating the first diode 220, the second diode 230, and the third diode 240 via the first control output 120, the second control output 130, and the third control output 140. The colors generated by the pulse modulated diodes, when viewed by an ordinary observer, would combine to form a pink color as is well known in the art.

Example 2

0[Pink]0[Black]. This instruction chain includes two commands. The first command (0[Pink]) immediately causes the controller 100 to control the Light emitting module 200 to generate a pink color as described above. The second command (0[Black]) immediately causes the controller 100 to control the Light emitting module 200 to produce a black color.

Example 3

0[Pink]5000[Black]. This instruction chain includes two commands. The first command (0[Pink]) immediately causes the controller 100 to change an existing color to pink. The second command (5000[Black]) causes the controller to change the color to black over at time period of 5000 milliseconds. In example embodiments, the change from pink to black may use a predetermined or default fade algorithm since no fade algorithm is specified in the command signal.

Example 4

0[Pink]2A5000[Black]. This instruction chain includes three commands. The first command (0[Pink]) immediately causes the controller 100 to change an existing color to pink. The second command (2A) selects a fade algorithm which is to be applied to a subsequent fading operation. In this case, the fade algorithm is "2". The third command (5000[Black]) causes the controller 100 to change the color to black over at time period of 5000 milliseconds using a fade algorithm identified as "2."

In example embodiments, various fade algorithms may be stored in a table which may be accessed by the controller 100. For example, as shown in Table 2, a table may include a plurality of identifiers identifying a type of fade algorithm. The fade algorithms, for example, may be, but are not limited to a linear and trigonometric fade algorithm. In example 4, therefore, the fade algorithm would correspond to a trigonometric fade algorithm. Though table 1 lists merely two fade algorithms, table 1 may include only a single fade algorithm or more than two fade algorithms.

TABLE 2

| Fade Algorithm | Description |
|---|---|
| 1 | Linear |
| 2 | Trigonometric |

Example 5

2000[Pink]1A5000[Black]. This instruction chain includes three commands. The first command (2000[Pink]) causes the controller 100 to change an existing color to pink over a time period of 2000 milliseconds. Because no fade algorithm is identified, this operation may use a predetermined or default fade algorithm. The second command (1A) selects a fade algorithm which is to be applied to a subsequent fading operation. In this case, the fade algorithm is "1" corresponding to a linear fade algorithm. The third command (5000[Black]) causes the controller 100 to change the color to black over at time period of 5000 milliseconds using a fade algorithm identified as "2."

Example 6

2T0[Pink]3A5000[Black]. This instruction chain includes four commands. The first command (2T) causes the controller 100 to wait until a second hand of a local clock's time equals "2" (an example of a specific time value) before processing and/or executing subsequent commands. The second command (0[Pink]) immediately causes the controller 100 to change an existing color to pink. Because no fade algorithm is identified, this operation may use a predetermined or default fade algorithm. The third command (3A) selects a fade algorithm to be used for a subsequent fade operation. The fourth command (5000[Black]) causes the controller 100 to change the color to black over at time period of 5000 milliseconds. In this particular nonlimiting example, the change from pink to black uses a fade algorithm identified as "3."

Example 7

200{300[Green]1000[Red]}. This instruction chain includes the operation of transitioning a color from green to red. In particular, this character string causes a controller 100 to change a color of LED unit 200 to change to green over a period of three hundred milliseconds using a default or predetermined fading algorithm (since one is not specified). The character string then causes the controller 100 to change the color of the LED unit 200 to red over a period of one thousand milliseconds using a default or predetermined fading algorithm (since one is not specified). These operations are repeated 200 times.

Example 8

10[Pink]. This instruction chain includes two operations. The first (!) causes the processor 100 to immediately stop processing any currently executing instructions and start executing instructions subsequent to this command even if there are unexecuted instructions sent earlier waiting to be processed or executed. The second command (0[Pink]) causes the controller 100 to cause the light emitting module 200 to immediately produce a pink color.

As indicated in Table 1, the colors identified in the instruction chain 300 may be any format. For example, in the event a user wished to identify the above color codes using Hex Code, rather than HTML color codes (as are provided above), the instructions chains may be expressed as:

0[FFCOCB] instead of 0[Pink];

0[FFCOCB]0[000000] instead of 0[Pink]0[Black];

0[FFCOCB]5000[000000] instead of 0[Pink] 5000 [Black];

0[FFCOCB]2A5000[000000] instead of 0[Pink]2A5000 [Black];

2000[FFCOCB]2A5000[000000] instead of 2000[Pink] 2A5000[Black];

2T0[FFCOCB]3A5000[000000] instead of 2T0[Pink] 3A5000[Black];

200{300[008000]1000[FF0000]} instead of 200{300 [Green]1000[Red]}; and

!0[FFCOCB] instead of !0[Pink]

In example embodiments, a color code embedded in an instruction chain 300 may be used in conjunction with a lookup table in order to determine proper illumination levels of light to be emitted by the light emitting devices 210 of the light emitting module 200. Table 3, for example, is a nonlimiting example of a color table useable with example embodiments. For example, in example embodiments, the first, second, and third light emitting devices 220, 230, and 240 may be diodes configured to produce a red light, a green light, and a blue light. In the event a purple color is desired, the instruction chain may include the command 0[Purple] to cause the light emitting module 200 to emit a purple light. In example embodiments, the controller 100 may, for example, use the variable "Purple" to lookup the proper illumination levels associated with the red, green, and blue diodes 220, 230, and 240 to produce a "purple" color. In this particular example, the controller 100 would determine the illumination level of the red diode 220 should be 50%, the illumination level of the green diode 230 should be 0%, and the illumination level of the blue diode 240 should be 50%.

TABLE 3

| Variable | Target Illumination Level of Red Diode | Target Illumination Level of Green Diode | Target Illumination Level of Blue Diode |
|---|---|---|---|
| Aqua | 0 | 100% | 100% |
| Black | 0 | 0 | 0 |
| Blue | 0 | 0 | 100% |
| Fuchsia | 100% | 0 | 100% |
| Gray | 50% | 50% | 50% |
| Green | 0 | 50% | 0 |
| Lime | 0 | 100% | 0 |
| Maroon | 50% | 0 | 0 |

TABLE 3-continued

| Variable | Target Illumination Level of Red Diode | Target Illumination Level of Green Diode | Target Illumination Level of Blue Diode |
|---|---|---|---|
| Navy | 0 | 0 | 50% |
| Olive | 50% | 50% | 0 |
| Purple | 50% | 0 | 50% |
| Red | 100% | 0 | 0 |
| Silver | 75% | 75% | 75% |
| Teal | 0 | 50% | 50% |
| White | 100% | 100% | 100% |
| Yellow | 100% | 100% | 0 |

In example embodiments, a user may upload one or more instruction chains 300 to the controller 100 via the data input 110. The instruction chains 300 may be stored in a queue where the instruction chains 300 may be stored for processing. The queue may, for example, be embodied in a computer readable medium such as, but not limited to, a random access memory chip. In the event multiple commands 300 are sent to the controller 100, each command may be stored in the queue and processed in order. For example, as shown in FIG. 2, a plurality of instruction chains 300 may be uploaded to the controller 100 and stored in a queue.

In example embodiments, the instruction chains 300 may be processed by the controller 100 to control the LED module unit 200. In example embodiments, for example, the controller 100 may include a microprocessor and/or a computer readable medium with instructions thereon to control the LED module 200 in accordance with the instruction chain 300 or a plurality of instruction chains. FIGS. 3A-3G, for example illustrate various instructions that may be used to process an instruction chain or a plurality of instruction chains 300.

Figure 3A:
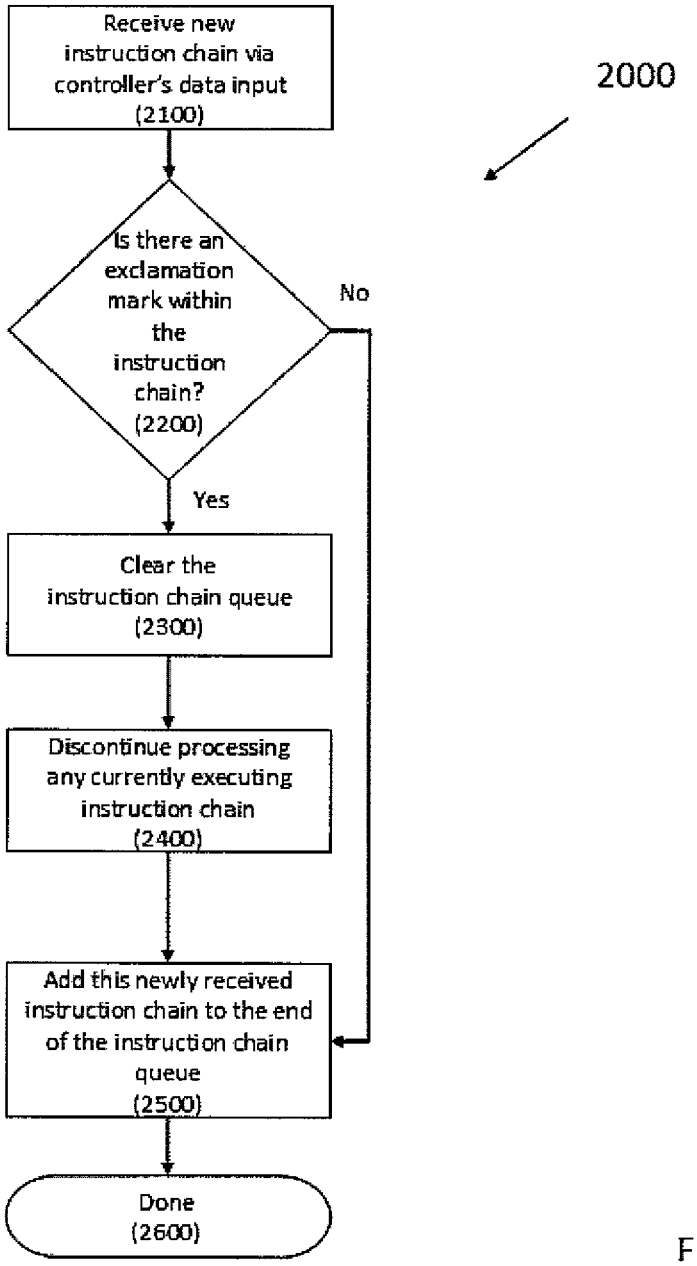
FIGS. 3A-3G illustrate an algorithm for controlling a system in accordance with example embodiments.

FIG. 3A, for example, includes the operation 2100 of receiving an instruction chain 300 via the controller's data input 110. In example embodiments, the controller 100 determines if the instruction chain 300 includes an exclamation point as shown in operation 2200. If so, the instruction chain queue is cleared and any processes associated with any stored instructions chains 300 are terminated and the new chain 300 is added to the end of the instruction queue as illustrated in operations 2300, 2400, and 2500. If no exclamation point is found, then the chain 300 is added to the queue for processing.

Figure 3B:
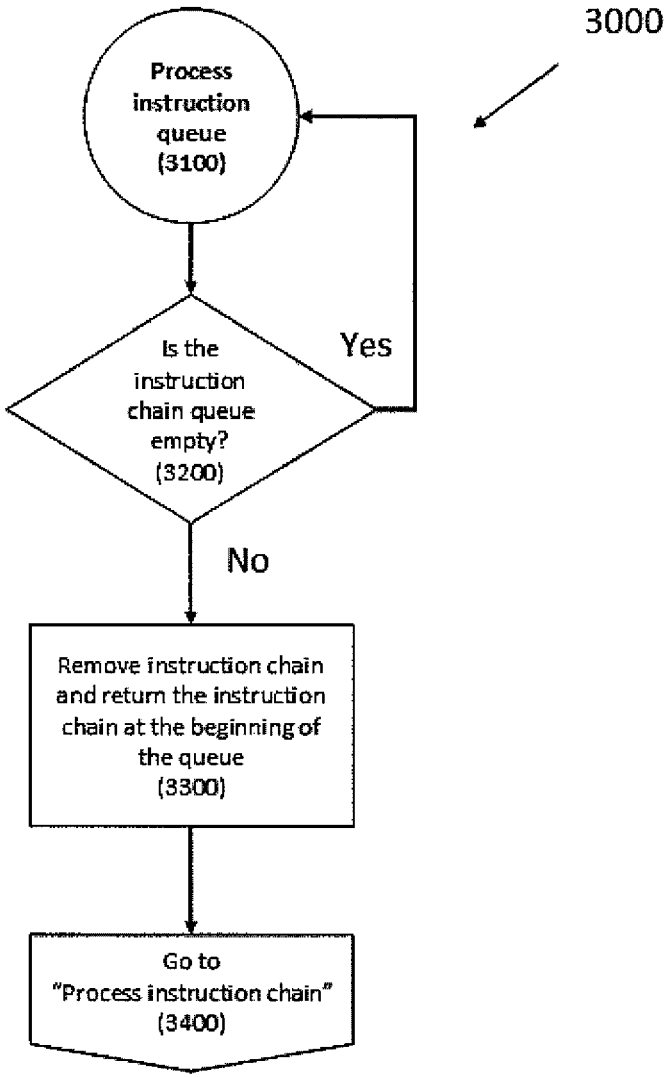
Figure 3C:
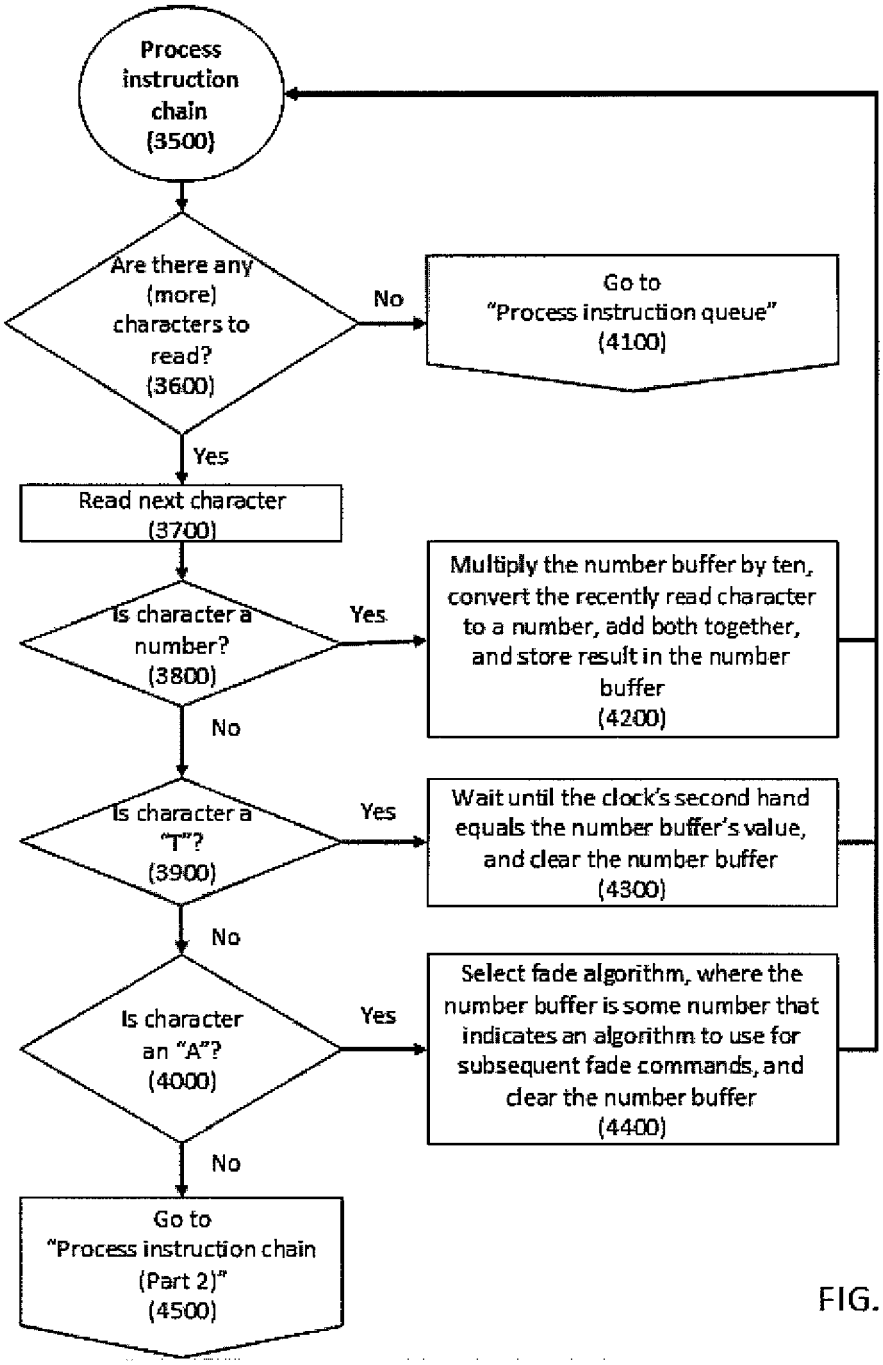
Figure 3D:
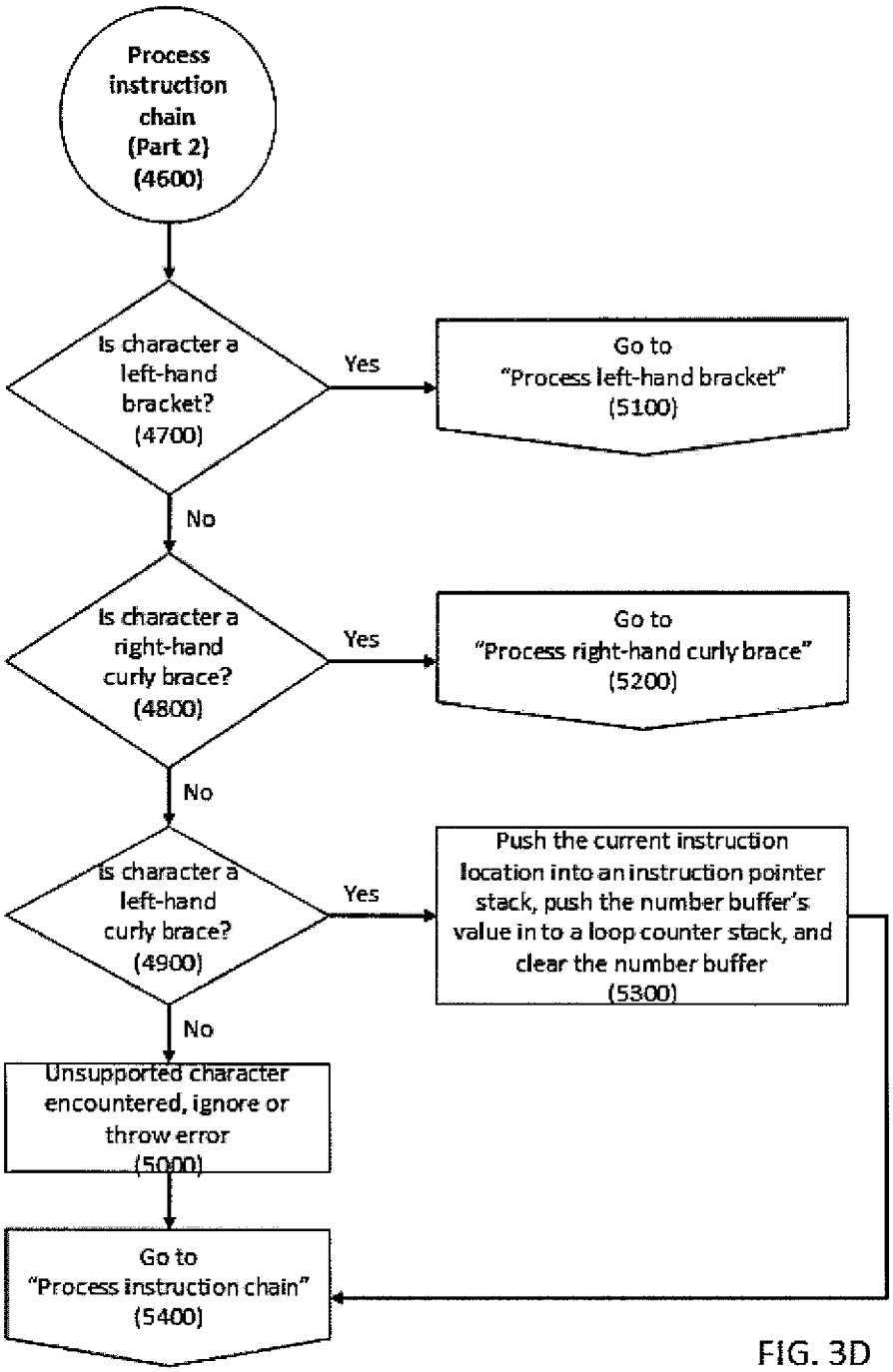
Figure 3E:
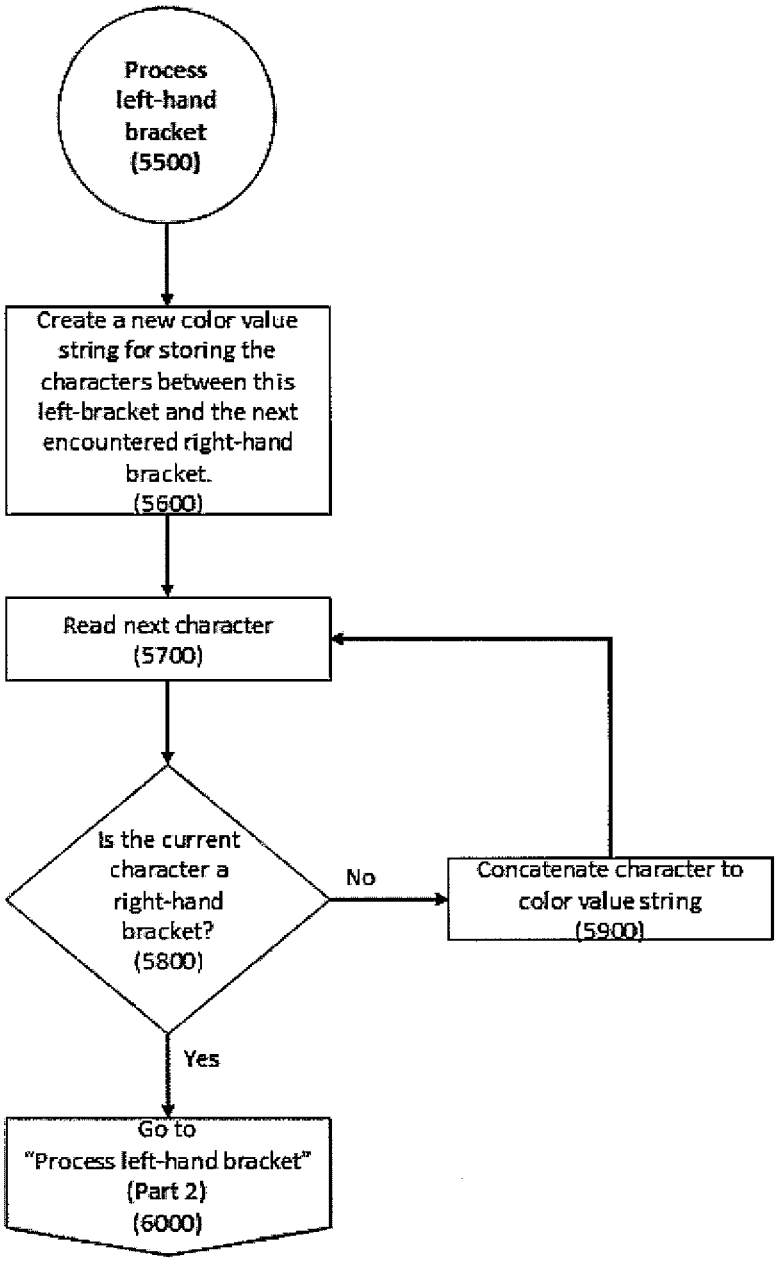
Figure 3F:
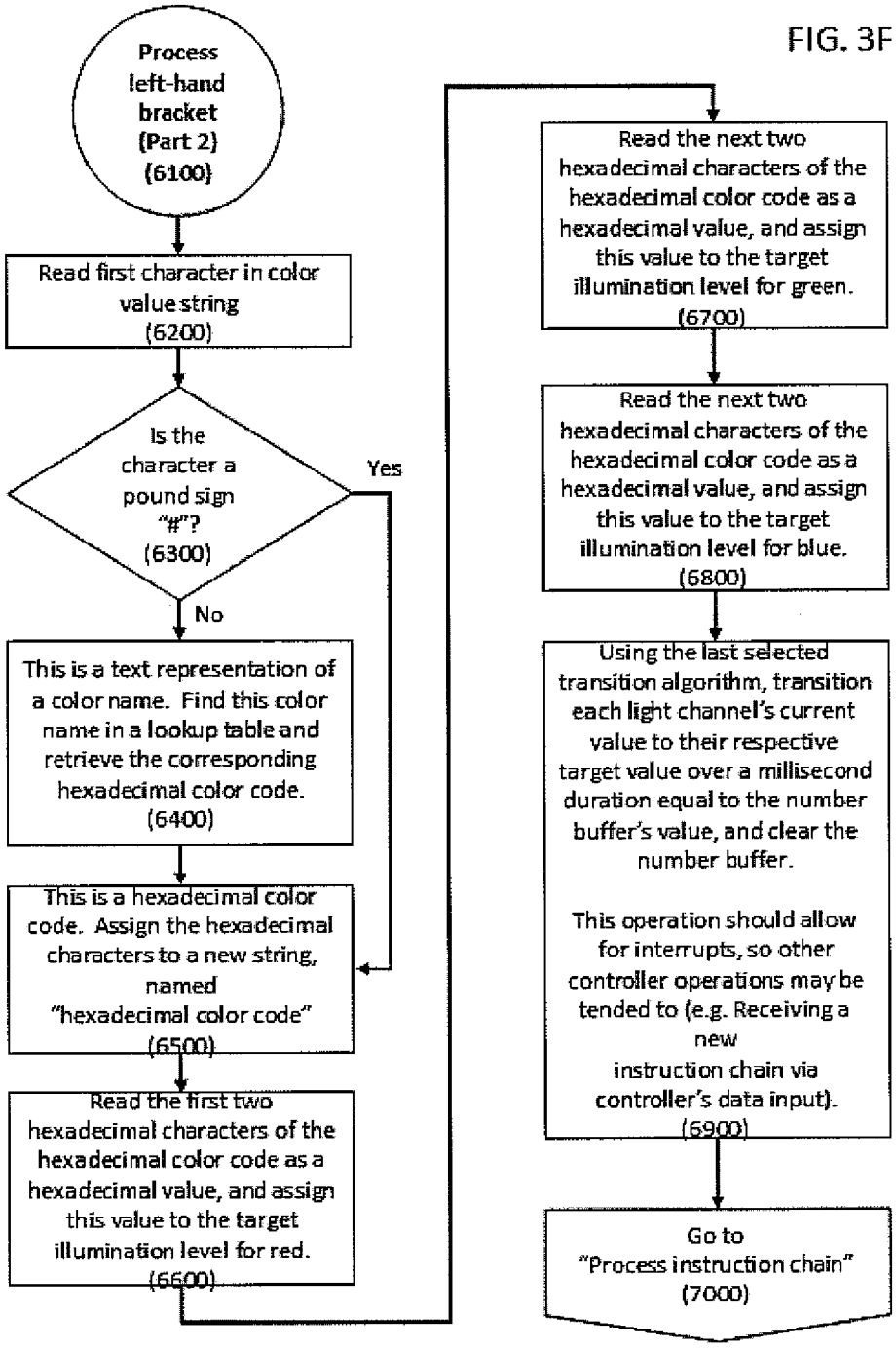

FIG. 3B illustrates operations associated with processing instruction chains 300 stored in the instruction queue. For example, the controller 100 may be configured to constantly check to see if the instruction queue is empty as shown in operation 3200. If the instruction queue is not empty, then the instruction at the beginning of the instruction queue is returned for processing as illustrated in operations 3300 and 3400.

Figure 3G:
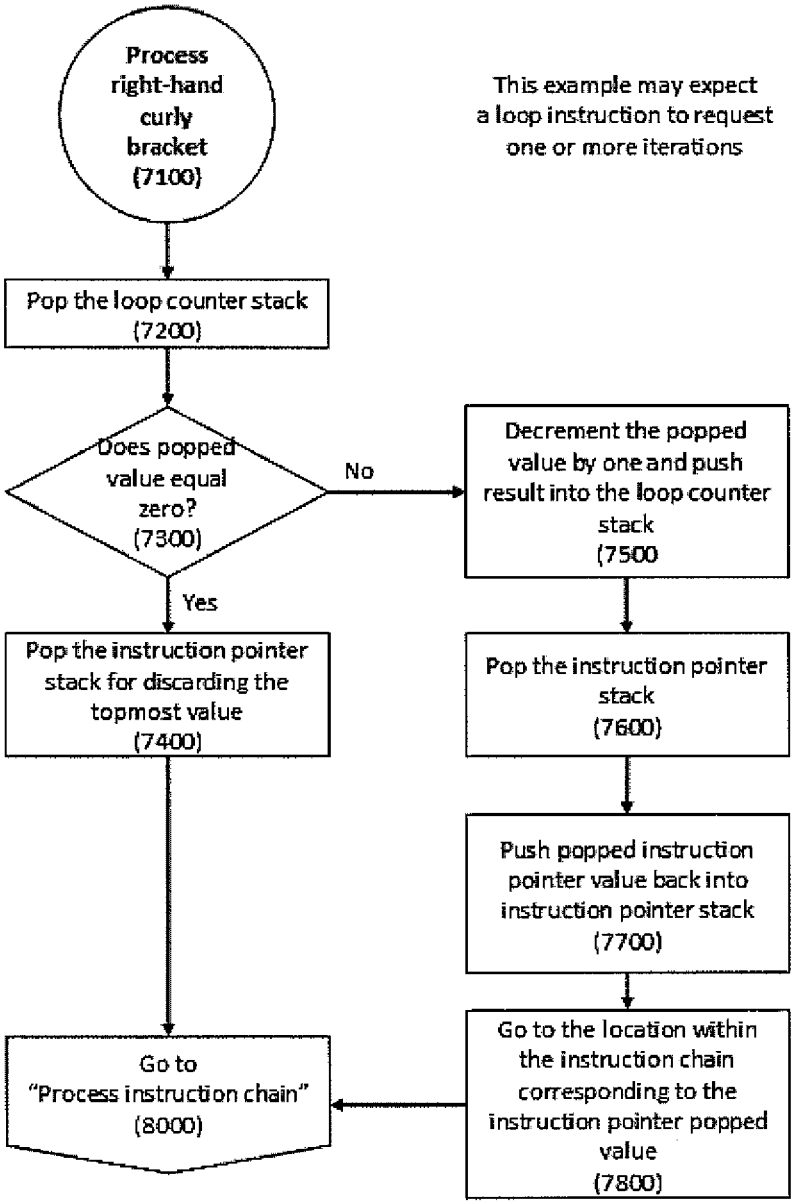

FIGS. 3C-3G illustrate various operations associated with processing a returned instruction chain. For example, the first operation 3600 is a logic operation which determines whether any (or any more characters) are to be read. If so, the "next" character (which may be the first character of an instruction chain 300 or a subsequent character of the instruction chain 300) is read. If the character is a number, then an existing buffer number (which may be zero) may be multiplied by 10 and the newly read number may be added to the existing number buffer. This sum may be stored as a number buffer as indicated in operation 4200. If the character is not a number, the algorithm checks to see if the character is one of a "T" (see operation 3900), an "A" (see operation 4000), a left hand bracket (see operation 4700), a right-hand curley brace (e.g. }, see operation 4800), or a left-hand curly brace (e.g. {, see operation 4900) which, depending on the character, may provoke operations of delaying an execution of a command (operation 4300), selecting a fade algorithm (operation 4400), or executing subroutines related right and left hand brackets and right and left hand curly braces (see operations 5100, 5200, and 5300). For example, in the event the character is a left hand bracket, then the process steps 5600, 5700, 5800, 5900, 6000, 6100, 6200, 6300, 6400, 6500, 6600, 6700, 6800, 6900, and 7000 may be executed. If the character is a left hand curly brace, the current instruction location may be pushed into an instruction pointer stack, the number buffer's value may be pushed into a loop counter stack, and the number may be cleared as illustrated in operation 5300 and the operations associated with the "process instruction chain" may be repeated until a right hand curly brace is read. If the character is a right hand curly brace, then the operations 7200, 7300, 7400, 7500, 7600, 7700, 7800, and 8000, as illustrated in FIG. 3G, may be executed.

It is understood that the algorithm(s) illustrated in FIGS. 3A-3G is merely an example and is by no means an attempt to limit the invention as various algorithms may be devised to process the instructions 300.

In the conventional art, LED lighting may be operated at a relatively low voltage. For example, the light emitting module 200 of example embodiments may operate at a voltage of about 24 V or less.

As explained above, if an instruction chain 300 includes the command "!" the controller 100 may quit executing any commands that are in the queue. For example, in the event the instruction chained received by the controller 100 at 10:05:01 am includes the command "!", the controller 100 would cease processing and executing any of the previously uploaded instruction chains 300 and would immediately start processing and/or executing the commands following the "!" command.

Example embodiments of the invention have been described in an illustrative manner. It is to be understood that the terminology that has been used is intended to be in the nature of words of description rather than of limitation. Many modifications and variations of example embodiments are possible in light of the above teachings. Therefore, within the scope of the appended claims, the present invention may be practiced otherwise than as specifically described.

What is claimed is:

1. An illumination controller comprised of:

a data input configured to receive a sequence of instructions, the instructions having at least one fade command that specifies a fade duration, at least one color code, and a wait command with a specific time value;

a processor to process the instructions; and a plurality of outputs configured to control a plurality of light emitting devices, the light emitting devices including a first device configured to emit a first light of a first color, a second device configured to emit a second light of a second color, and a third device configured to emit a third light of a third color, wherein the processor is configured to determine, based on the at least one color code, a first target illumination level of the first light emitted by the first light emitting device, a second target illumination level of the second light emitted by the second light emitting device, and a third target illumination level of the third light emitted by the third light emitting device, control, based on the at least one fade command, the first light emitting device to emit light of the first target illumination level, the second light emitting device to emit light of the second target illumination level, and the third light emitting device to emit light of the third target illumination, and pause, in response to the wait command, executing subsequent commands until the specific time value is attained, the specific time value being associated with a local clock.

2. The illumination controller of claim 1, wherein the first color is red, the second color is green, and the third color is blue.

3. The illumination controller as defined in claim 1, wherein the sequence of instructions is an ASCII string.

4. The illumination controller as defined in claim 1, wherein the data input is an Ethernet interface.

5. The illumination controller as defined in claim 1, wherein the data input is a Power-over-Ethernet interface.

6. The illumination controller as defined in claim 1, wherein the data input is an IP network interface.

7. The illumination controller as defined in claim 1, wherein the data input is a Cisco EnergyWise interface.

8. The illumination controller as defined in claim 1, wherein the data input is a serial interface.

9. The illumination controller as defined in claim 1, wherein the data input is an RS-232 interface.

10. The illumination controller as defined in claim 1, wherein the data input is an RS-485 interface.

11. The illumination controller as defined in claim 1, wherein the data input is a wireless interface.

12. The illumination controller as defined in claim 11, wherein the data input is an IP network interface.

13. The illumination controller as defined in claim 1, wherein the illumination controller uses pulse frequency modulation for modulating the first, second, and third channels.

14. The illumination controller as defined in claim 1, wherein the illumination controller uses a linear driver for regulating the power output to the first, second, and third channels.

15. The illumination controller as defined in claim 1, wherein the instructions include an identifier corresponding to a fade algorithm.

16. The illumination controller as defined in claim 1, wherein the instructions include a first symbol associated with repeating commands between the first symbol and a second symbol.

17. The illumination controller as defined in claim 1, further comprising;

a queue configured to store a plurality of instructions.

18. The illumination controller as defined in claim 17, wherein the processor is configured to sequentially process the plurality of instructions in the queue.

19. The illumination controller as defined in claim 1, wherein the processor is configured to stop processing and executing current instructions and jump immediately to an instruction following a newly received jump command.

20. A method of controlling a light comprising:

receiving a sequence of instructions having at least one fade command that specifies a fade duration, at least one color code, and a wait command with a specific time value, the specific time value being associated with a local clock;

determining, based on the at least one color code, a first target illumination level of a first light emitted by a first light emitting device, a second target illumination level of a second light emitted by a second light emitting device, and a third target illumination level of a third light emitted by a third light emitting device;

controlling, based on the at least one fade command, the first light emitting device to emit light of the first target illumination level, the second light emitting device to emit light of the second target illumination level, and the third light emitting device to emit light of the third target illumination; and pausing, in response to the wait command, executing subsequent commands until the specific time value associated with the local clock is attained.

21. The method of claim 20, further comprising:

determining, based on the at least one color code, a fourth target illumination level of a fourth light emitted by a fourth light emitting device, and controlling, based on the at least one fade command, the fourth light emitting device to emit light of the fourth target illumination.

22. A non-transitory computer readable medium configured to cause a computer to:

determine a first target illumination level of a first light emitted by a first light emitting device, a second target illumination level of a second light emitted by a second light emitting device, and a third target illumination level of a third light emitted by a third light emitting device, and control, based on the at least one fade command, the first light emitting device to emit light of the first target illumination level, the second light emitting device to emit light of the second target illumination level, and the third light emitting device to emit light of the third target illumination, wherein the non-transitory computer readable medium is further configured to control the computer to pause, based on the at least one wait command, an execution of subsequent commands received after the wait command, the at least one wait command having a specific time value associated with the computer's local clock.

23. An illumination controller comprised of:

a data input configured to receive a sequence of instructions, the instructions having at least one wait command and at least one color code, the at least one wait command having a specific time value associated with a local clock;

a processor to process the instructions; and a plurality of outputs configured to control a plurality of light emitting devices, the light emitting devices including a first device configured to emit a first light of a first color, a second device configured to emit a second light of a second color, and a third device configured to emit a third light of a third color, wherein the controller is configured to determine, based on the at least one color code, a first target illumination level of the first light emitted by the first light emitting device, a second target illumination level of the second light emitted by the second light emitting device, and a third target illumination level of the third light emitted by the third light emitting device, control, based on the at least one wait command, the first light emitting device to emit light of the first target illumination level, the second light emitting device to emit light of the second target illumination level, and the third light emitting device to emit light of the third target illumination, and pause, in response to the wait command, executing subsequent commands until the specific time value is attained.

24. The illumination controller of claim 23, wherein the first color is red, the second color is green, and the third color is blue.

25. The illumination controller as defined in claim 24, wherein the sequence of instructions is an ASCII string.

26. The illumination controller as defined in claim 23, wherein the data input is an Ethernet interface.

27. The illumination controller as defined in claim 23, wherein the data input is a Power-over-Ethernet interface.

28. The illumination controller as defined in claim 23, wherein the data input is an IP network interface.

29. The illumination controller as defined in claim 23, wherein the data input is a Cisco EnergyWise interface.

30. The illumination controller as defined in claim 23, wherein the data input is a serial interface.

31. The illumination controller as defined in claim 23, wherein the data input is an RS-232 interface.

32. The illumination controller as defined in claim 23, wherein the data input is an RS-485 interface.

33. The illumination controller as defined in claim 23, wherein the data input is a wireless interface.

34. The illumination controller as defined in claim 23, wherein the data input is an IP network interface.

35. The illumination controller as defined in claim 23, wherein the illumination controller uses pulse frequency modulation for modulating the first, second, and third channels.

36. The illumination controller as defined in claim 23, wherein the illumination controller uses a linear driver for regulating the power output to the first, second, and third channels.

37. The illumination controller as defined in claim 23, wherein the sequence of instructions further comprises a fade command, and the illumination controller is configured to control, based on the at least one fade command, the first light emitting device to emit light of the first target illumination level, the second light emitting device to emit light of the second target illumination level, and the third light emitting device to emit light of the third target illumination.

38. The illumination controller as defined in claim 23, wherein the illumination controller is configured to determine whether the at least one color code is text representative of a color and, if so, find a color name in a look up table that includes hexadecimal color codes.

39. A system comprising:

an illumination controller comprised of a data input configured to receive a sequence of instructions and a processor configured to process the sequence of instructions, the instructions having at least one wait command and at least one color code, the at least one wait command having a specific time value associated with a local clock;

a plurality of light emitting devices, the light emitting devices including a first device configured to emit a first light of a first color, a second device configured to emit a second light of a second color, and a third device configured to emit a third light of a third color; and a plurality of outputs connecting the controller to the plurality of light emitting devices, wherein the controller is configured to determine, based on the at least one color code, a first target illumination level of the first light emitted by the first light emitting device, a second target illumination level of the second light emitted by the second light emitting device, and a third target illumination level of the third light emitted by the third light emitting device, pause, in response to the wait command, executing subsequent commands until the specific time value associated with the local clock is attained, and control the first light emitting device to emit light of the first target illumination level, the second light emitting device to emit light of the second target illumination level, and the third light emitting device to emit light of the third target illumination when the specific time value in the wait command is attained.

* * * * *